US011536486B2

(12) United States Patent
Rahimi

(10) Patent No.: US 11,536,486 B2
(45) Date of Patent: Dec. 27, 2022

(54) ASSEMBLY AND METHOD FOR PREVENTING WATER DAMAGE TO INSULATED EXHAUST DUCTS

(71) Applicant: Iraj A. Rahimi, Potomac, MD (US)

(72) Inventor: Iraj A. Rahimi, Potomac, MD (US)

( * ) Notice: Subject to any disclaimer, the term of this patent is extended or adjusted under 35 U.S.C. 154(b) by 0 days.

(21) Appl. No.: 17/316,414

(22) Filed: May 10, 2021

(65) Prior Publication Data

US 2021/0262694 A1 Aug. 26, 2021

Related U.S. Application Data

(60) Provisional application No. 63/146,944, filed on Feb. 8, 2021.

(51) Int. Cl.
*F24F 13/20* (2006.01)
*F24F 7/02* (2006.01)

(52) U.S. Cl.
CPC ..... *F24F 13/20* (2013.01); *F24F 7/02* (2013.01)

(58) Field of Classification Search
CPC ..... F24F 7/02
See application file for complete search history.

(56) References Cited

U.S. PATENT DOCUMENTS

| | | | | | |
|---|---|---|---|---|---|
| 3,934,383 | A * | 1/1976 | Perry | E04D 13/0352 | 49/342 |
| 4,231,288 | A * | 11/1980 | Finley | E04D 13/1476 | 415/121.3 |
| 5,081,914 | A * | 1/1992 | Mejia | F24F 7/02 | 454/366 |
| 5,568,947 | A * | 10/1996 | Paquette | E04F 17/04 | 285/192 |
| 6,102,794 | A * | 8/2000 | Cline | F24F 7/02 | 454/368 |
| 9,428,900 | B2 * | 8/2016 | Wroblewski | E03F 5/0407 | |
| 10,830,464 | B1 * | 11/2020 | Stevenson | F24F 7/007 | |
| 2019/0249439 | A1 * | 8/2019 | Oddy | E04D 13/1476 | |
| 2019/0316341 | A1 * | 10/2019 | Say | E03F 5/0411 | |

OTHER PUBLICATIONS

GAF_Ventilation_Brochure, GAF, Ventilation, 2019, p. 21, "Replacement Wind Turbine Adjustable Bases & Weather Caps" (Year: 2019).*

* cited by examiner

*Primary Examiner* — Steven B McAllister
*Assistant Examiner* — Charles R Brawner
(74) *Attorney, Agent, or Firm* — Barry Choobin; Patent 360

(57) ABSTRACT

An exhaust vent cap assembly can be installed in a roof deck of a building to allow a one-time connection of the insulated duct to the roof from exhaust fans within the building.

11 Claims, 10 Drawing Sheets

ASSEMBLY AND METHOD FOR PREVENTING WATER DAMAGE TO INSULATED EXHAUST DUCTS

CROSS-REFERENCE TO RELATED APPLICATIONS

This application claims priority to the U.S. provisional patent application Ser. No. 63/146,944, filed on Feb. 8, 2021, which is incorporated herein by reference in its entirety.

FIELD OF INVENTION

The present invention relates to an exhaust vent cap assembly, and more particularly, the present invention relates to an exhaust vent cap assembly for preventing water damage to insulated exhaust ducts and fan assembly of a ventilation system in a building.

BACKGROUND OF INVENTION

As part of the ventilation system of a house, exhaust fans are installed in bathrooms or toilets to remove the odor and moist air to the outside of the house. Fans are usually installed in the ceiling of bathrooms to egress exhaust air. A small duct is connected to the fan and runs through space between floors or in the attic to vent air to the outside. The ducts end in the roof deck or outside walls of a building. The roof deck is prepared for installing the duct by making a round hole of the size proportional to the size of the duct either on the outer wall of the house or in the roof deck for the air to exhaust to the outside (called, penetration).

Roofer later installs a waterproof cap over the hole where the duct is attached, to waterproof the penetrations. In colder climates, the moist air running through the round duct to the outside can condensate and water will drip down to the fan assembly in the ceiling of the bathroom or where the fan is installed and cause damage. To avoid condensation issues, ducts are insulated. To ease installation, round flexible ducts with insulation around them, also known as flex ducts, are used in connecting the fans to the roof culler.

During construction of a building, the HVAC company installs the fans in the ceilings and makes a round hole in the plywood (roof deck) and attaches the duct to a piece of round steel tube and attaches the round tube to underneath the roof deck in front of the hole on the roof. The round tube is secured to the roof deck with few metal-sheet strips. The hole is open to the outside air for the rain to get into the duct.

In the normal course of construction, the HVAC personnel are the first trade to work on the house once the house is framed. The plumber and then electrician come after HVAC workers and other trades follow them. Roofers install the roof when HVAC personnel and plumbers have made the penetrations and done with their work. Therefore, the holes that HVAC personnel make on the roof are open to the atmosphere till the roofers come and install the permanent cap over the holes.

There could be a one- or two-weeks gap or even sometimes more till the holes on the roof can be covered by the permanent caps. During such time, rain or snow often comes and water travels down the open hole toward the fan and brings water inside the house, and also damages the insulation around the duct attached to the fan.

The HVAC personnel must come back and replace the ducts that were soaked with water and deemed useless. With a typical house having two-three vents through the roof, the cost of replacing the flexible duct or the insulation around the ridged duct can get expensive. Since these ducts are in the attic, workers must maneuver between the roof trusses and frame members to make the holes and attach the roof collar. This makes the work even more challenging and labor-intensive. The additional material and labor with the trip to make the repairs add to the operational expense of the HVAC Company, chipping away at their profits. This phenomenon happens repeatedly and often enough that the cost of the additional repairs becomes substantial.

Both the consumers and the industries have a desire for a solution to the aforesaid problems.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an exhaust vent cap assembly for preventing damage to insulated exhaust ducts.

It is another object of the present invention that the assembly prevents labor, cost, and time for replacing the damaged ducts.

It is still another object of the present invention that the assembly prevents undesired alterations in the building for replacing the damaged insulated exhaust ducts.

It is a further object of the present invention that the assembly is easy to install.

It is yet another object of the present invention that the assembly is economic to manufacture.

In one aspect, disclosed is an exhaust vent cap assembly that can be installed in a roof deck of a building to allow onetime connection of the insulated duct to the roof from exhaust fans within the building.

These and other objects and advantages of the embodiments herein and the summary will become readily apparent from the following detailed description taken in conjunction with the accompanying drawings.

BRIEF DESCRIPTION OF DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Disclosed is an exhaust vent cap assembly for a ventilation system of a building. The disclosed exhaust vent cap assembly secures the insulated exhaust ducts of the ventilation system to the roof deck or outer wall of the building. Disclosed exhaust vent cap assembly eliminates the redundant work and the extra costs associated with replacing the insulated exhaust ducts in the attic that are damaged by water and stopping water from entering the house through the exhaust fans.

Figure 1:
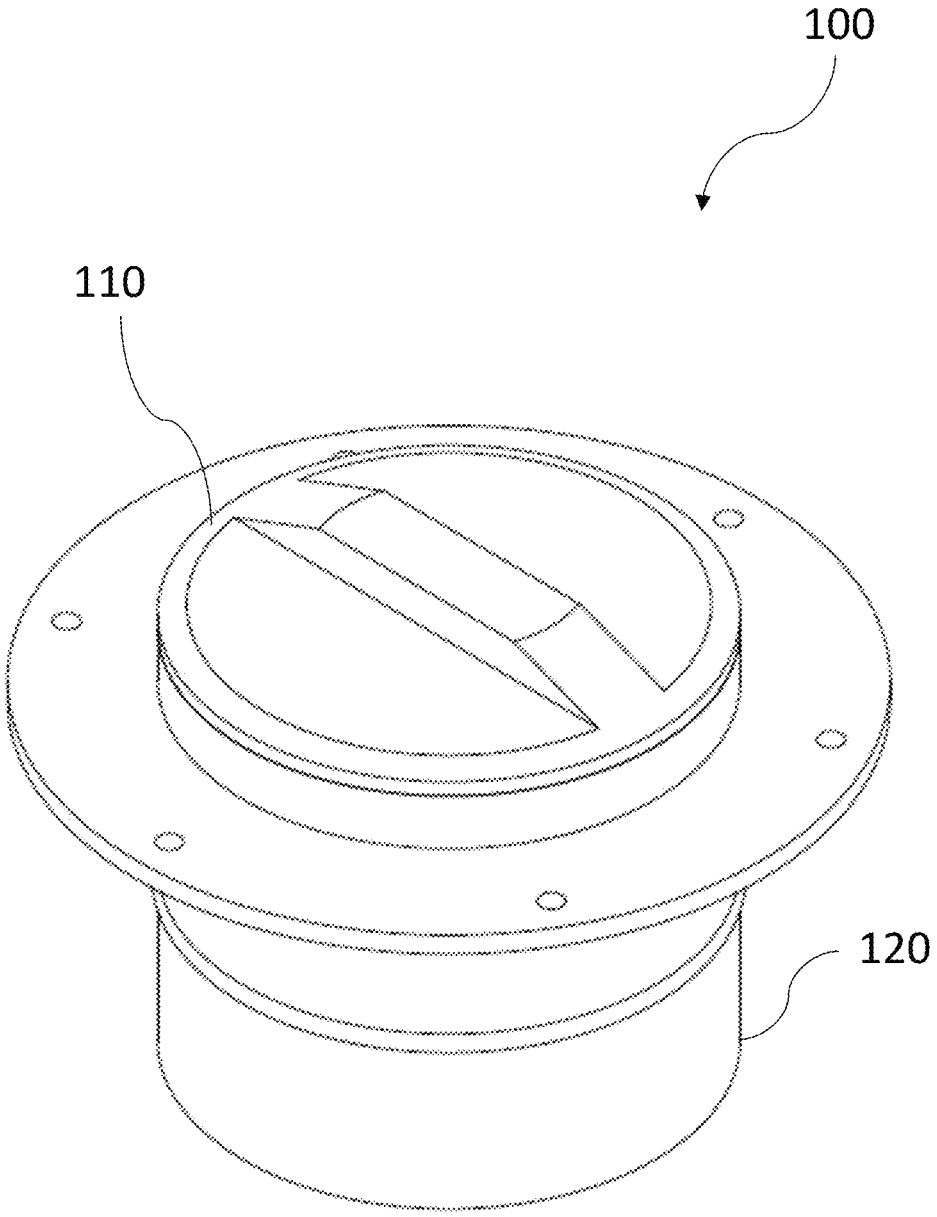
FIG. 1 is a perspective view of the disclosed exhaust vent cap assembly, according to an exemplary embodiment of the present invention.
Figure 2:
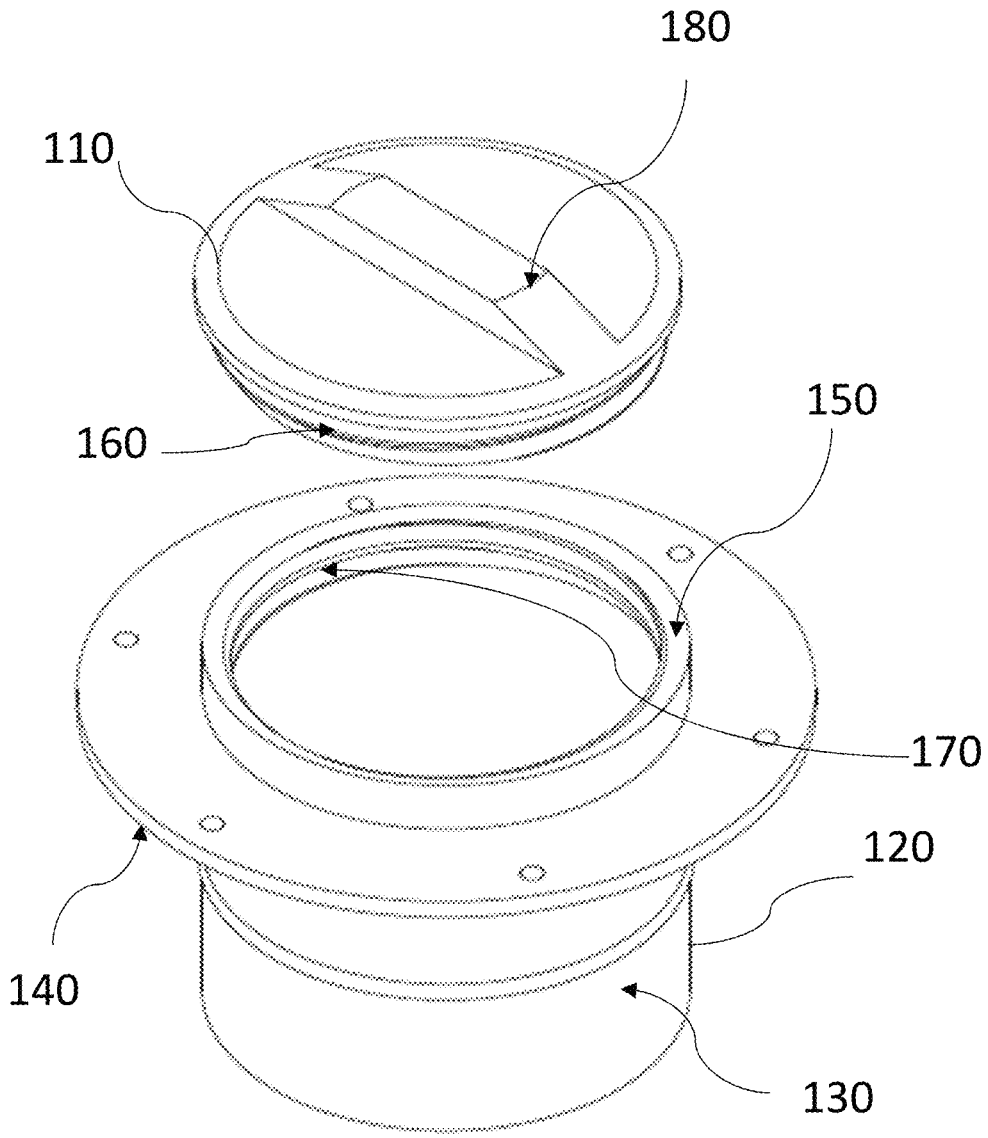
FIG. 2 is an exploded view showing the cap and the tubular body of the disclosed exhaust vent cap assembly, according to an exemplary embodiment of the present invention.
Figure 3:
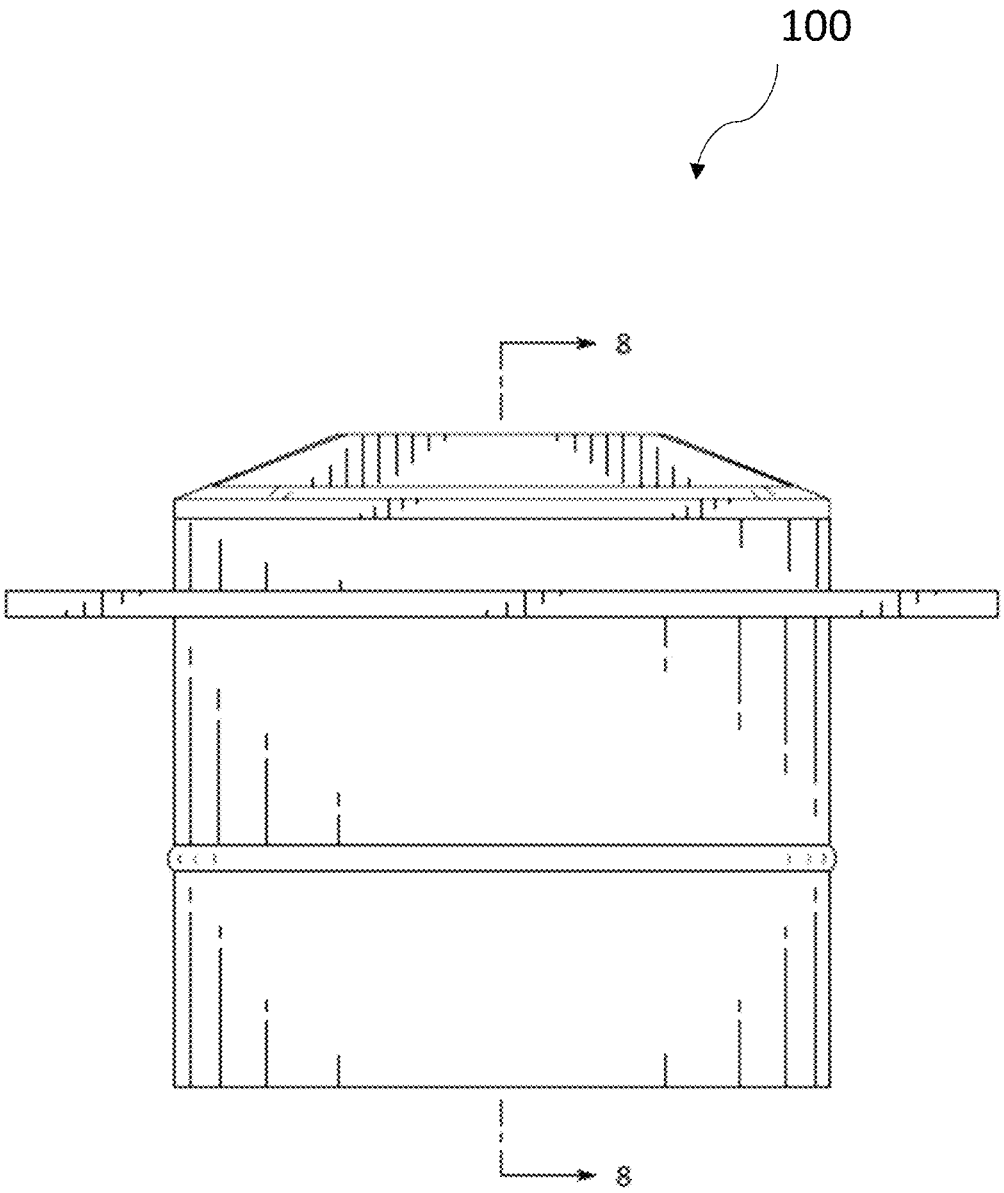
FIG. 3 is a side planar view of the exhaust vent cap assembly, according to an exemplary embodiment of the present invention.
Figure 4:
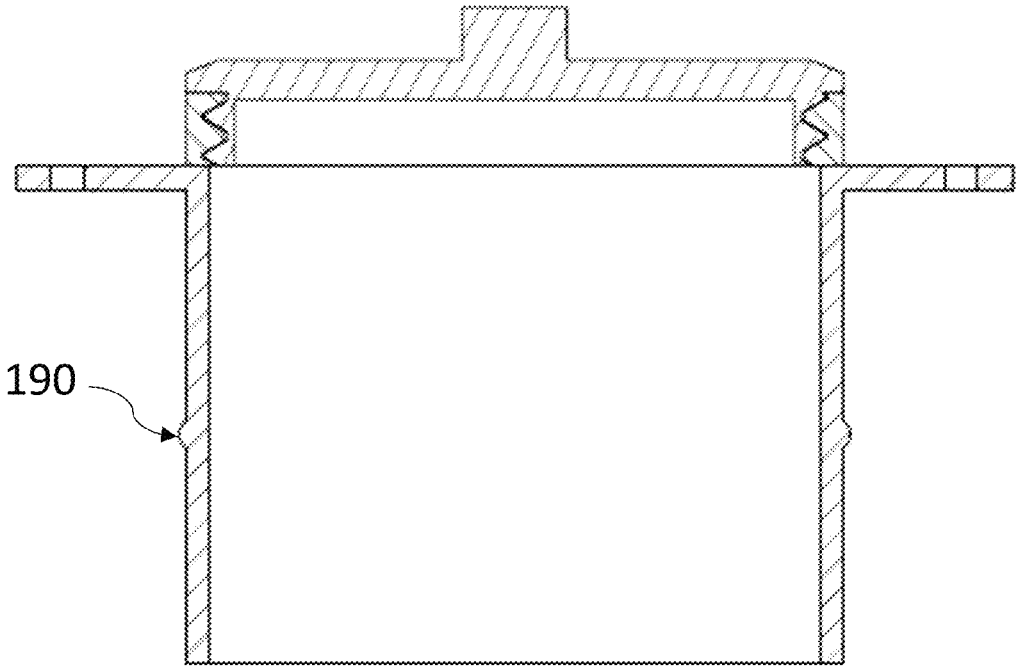
FIG. 4 is a sectional view of the exhaust vent cap assembly taken along the line 8-8 of FIG. 3, according to an exemplary embodiment of the present invention.
Figure 5:
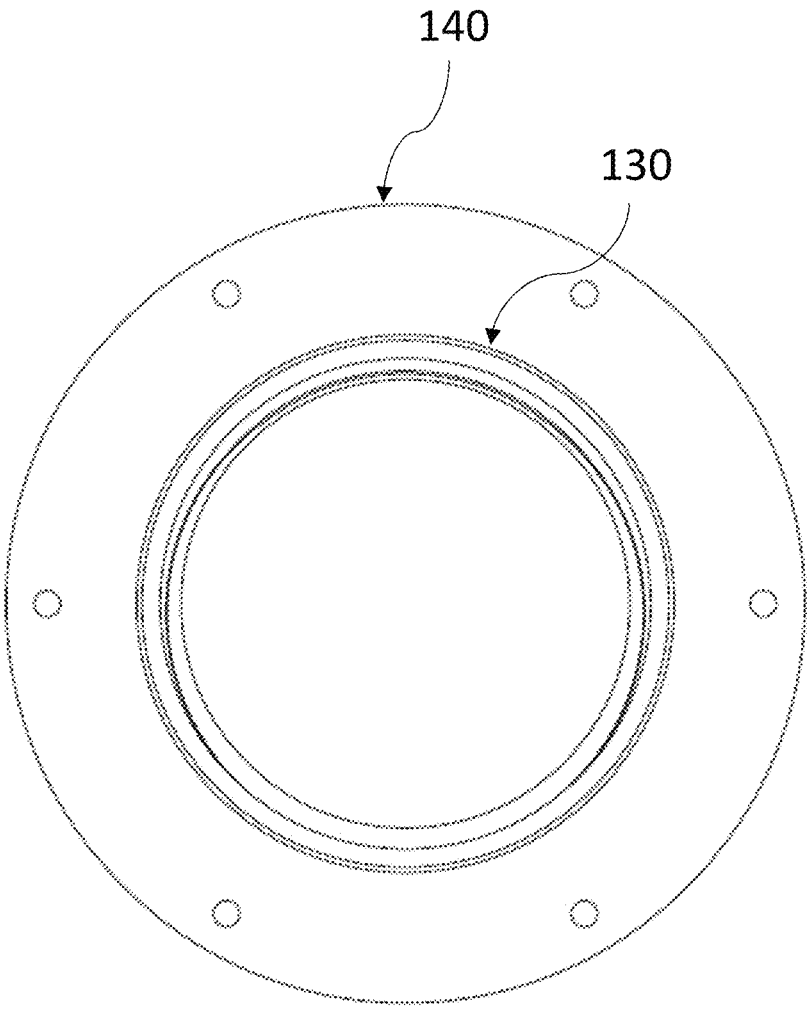
FIG. 5 is a bottom view of the exhaust vent cap assembly, according to an exemplary embodiment of the present invention.

Referring to FIG. 1, which shows the disclosed exhaust vent cap assembly 100 having a cap 110 and a tubular body 120. FIG. 2 is an exploded view of the exhaust vent cap assembly 100 showing the cap 110 separated from the tubular body 120. The tubular body 120 having a cylindrical hollow tubular body 130 that is rigid and made of durable material. The cylindrical hollow tubular body 130 having a proximal end and a distal end. Around the periphery of the proximal end of the cylindrical hollow tubular body 130 extends a flange 140 perpendicular to the cylindrical hollow tubular body 130. The flange 140 can be used to secure the disclosed exhaust vent cap assembly 100 to the roof deck or the outer wall. The flange 140 can be welded to the tubular body 130, mechanically fastened or can be continuous with the wall of the tubular body. At the proximal end of the tubular body can be seen a mouth 150 of the tubular body 120. The mouth and the cap can have a fastening mechanism for securing the cap to the mouth. The cap sealably engages with the mouth 150 of the tubular body 120 to prevent the ingress of water into the tubular body and the ducts. FIG. 2 shows the cap and the mouth having corresponding threads 160 and 170 for securing the cap 110 to the mouth. An O-ring may be used between the cap 110 and mouth 150 to further assist in water tightness. FIG. 3 is a side planar view and FIG. 4 is a sectional view showing the cap secured to the mouth wherein the threads of the cap are engaged to the threads of the mouth of the tubular body. A ridge 190 can also be seen in FIG. 4 which helps in retaining the duct over the tubular body. FIG. 5 is a bottom view of the tubular body 120 showing the hollow cylindrical tubular body. The cap can also include a handle 180 for turning the cap 110 over the mouth 150 of the tubular body 130.

Figure 6:
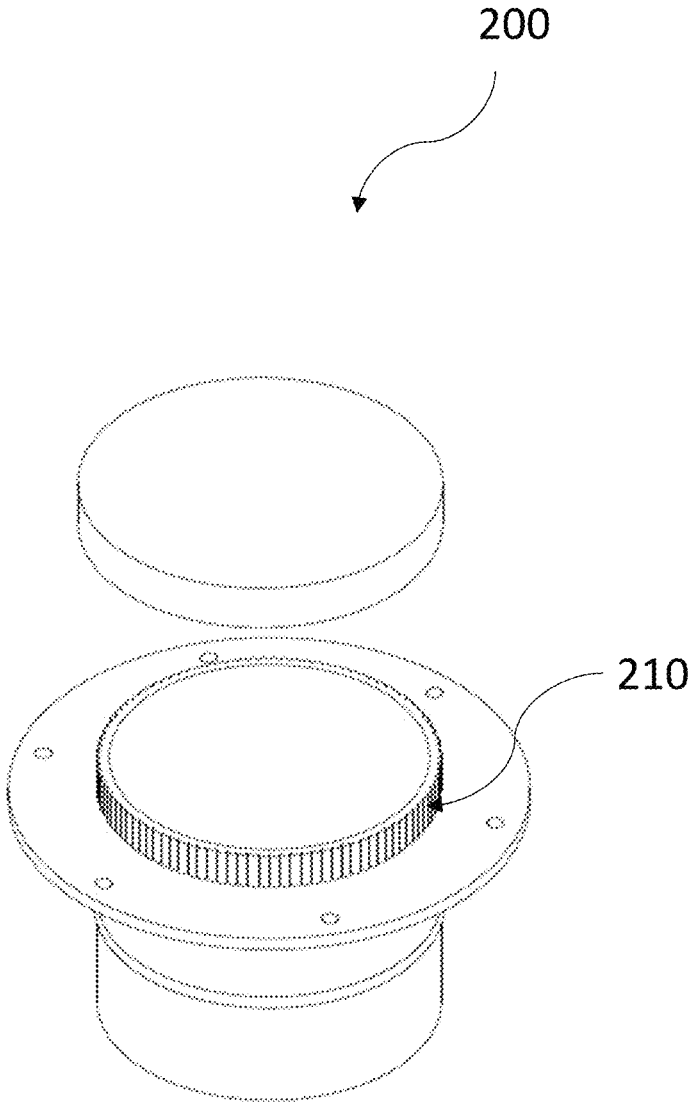
FIG. 6 is an exploded perspective view of another exemplary embodiment of the exhaust vent cap assembly, according to the present invention.

The fastening mechanism and the handle can be varied for desired water tightness. FIG. 2 shows the roof cap assembly having the screw mechanism. The screw mechanism can be replaced by the snap-fit mechanism. FIG. 6 shows the assembly 200 having the cap and mouth, wherein the cap can be snap-fit over the mouth of the tubular body. The cap can be plane from inside, wherein vertical ridges 210 are shown on an outer surface of the mouth. The vertical ridges around the mouth can be replaced by horizontal ridges that surround the mouth. The top of the cap is planar and may not have any handle.

Figure 7:
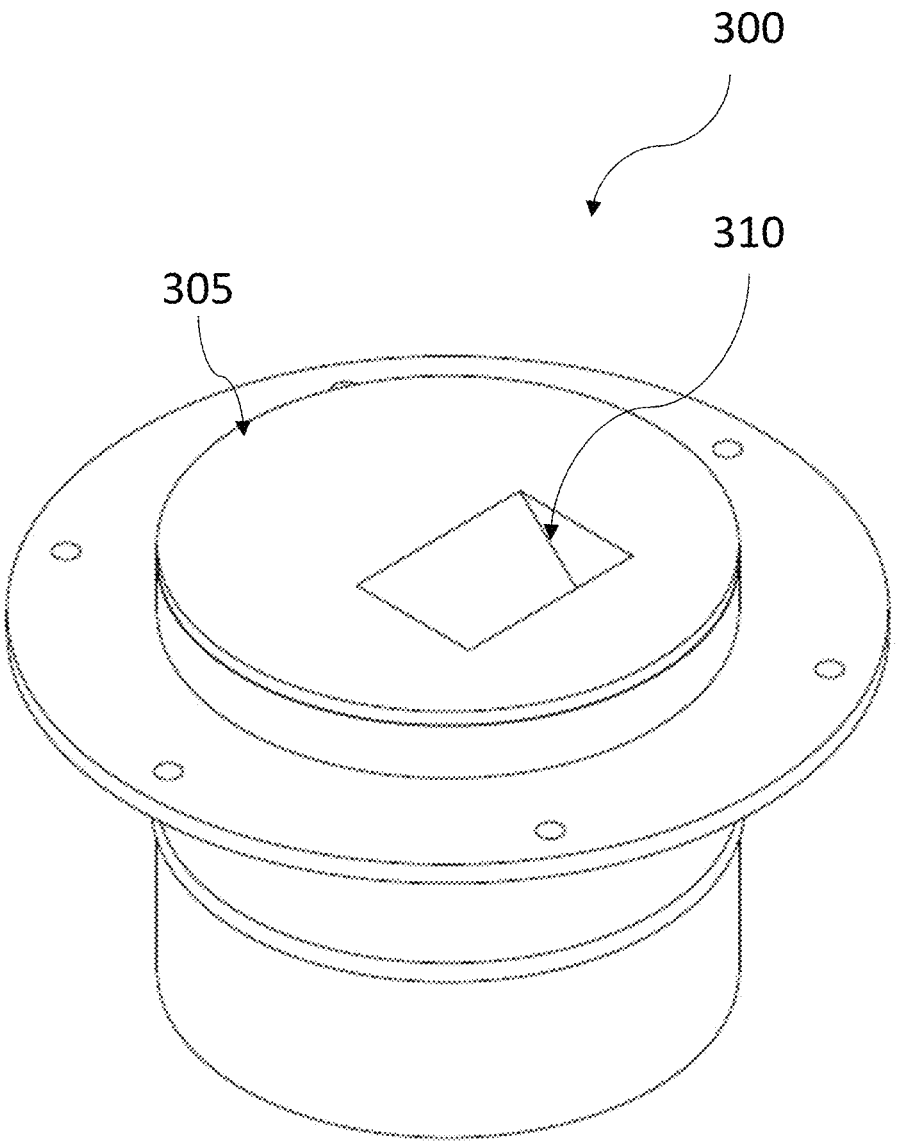
FIG. 7 is a perspective view of another exemplary embodiment of the exhaust vent cap assembly, according to the present invention.
Figure 8:
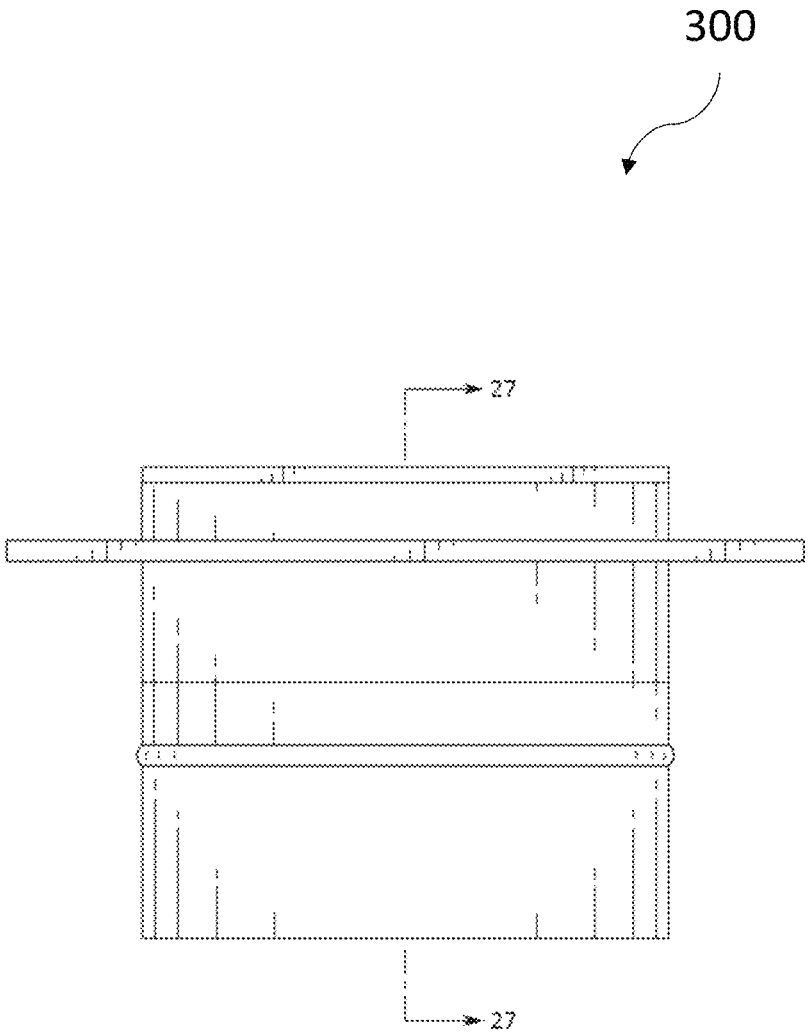
FIG. 8 is a side view of the exhaust vent cap assembly shown in FIG. 7, according to an exemplary embodiment of the present invention.
Figure 9:
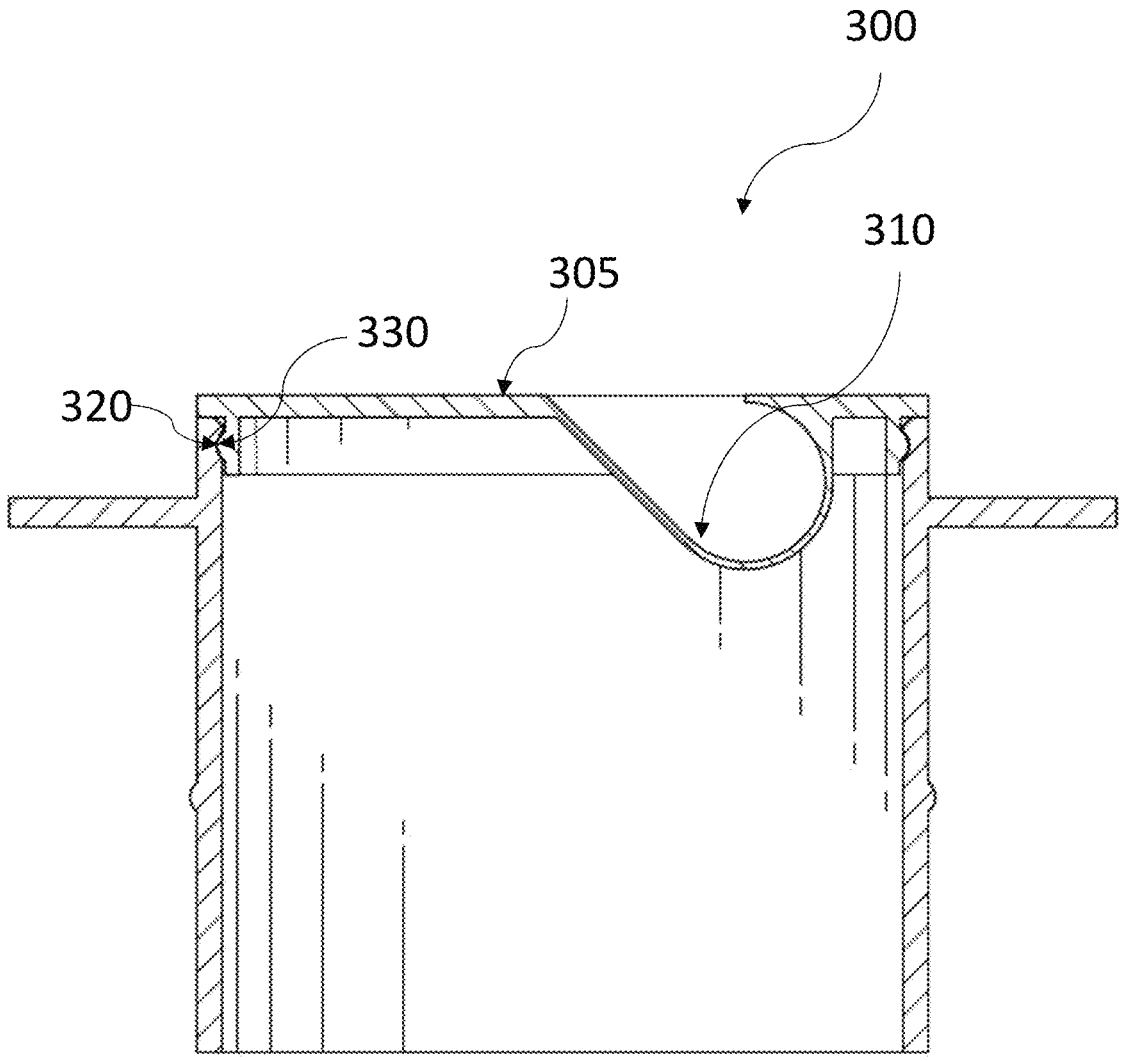
FIG. 9 is a sectional view of the exhaust vent cap assembly taken along the line 27-27 shown in FIG. 8, according to an exemplary embodiment of the present invention.

FIG. 7 shows another exemplary embodiment of the exhaust vent cap assembly 300, wherein the cap 305 is having a furrow 310 which can act as a handle for lifting the cap 305. FIG. 8 is a side view of the exhaust vent cap assembly 300. FIG. 9 is a cross-sectional view of the exhaust vent cap assembly shown in FIG. 8 taken along line 27-27. The tubular body can have circling recess 320 which engages with a dimple 330 in the outer wall of the cap 305. This assembly can be made from a variety of materials, such as plastics, metal, composite materials, etc. The shape of the cap and handle can be varied. Similarly, any fastening mechanism for sealably securing the cap to the tubular body is within the scope of the present invention.

The removable cap can have different shapes to achieve water tightness. It can be snapped onto the top of the tubular member. It can also be a shape of a lid that goes over the tube having friction fit, a cap that can be screwed onto the tubular member by fasteners, or other methods of securing the cap to the tubular member so it is not easily removed by wind.

All these methods are meant to produce a waterproof assembly so water may not be able to seep inside the insulated ducts.

Figure 10:
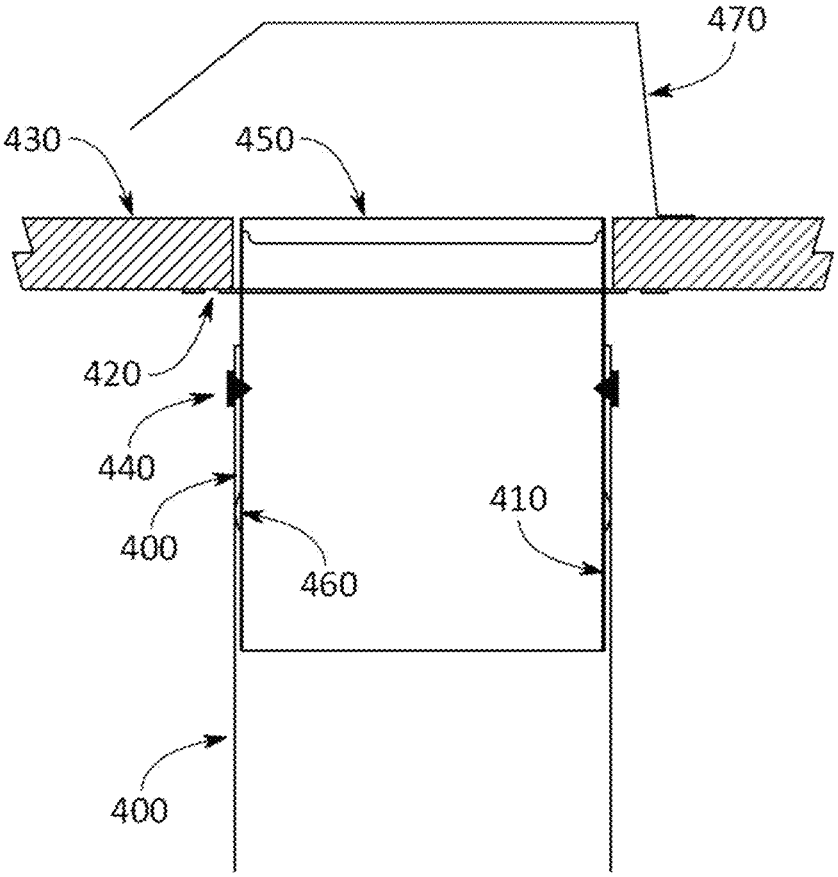
FIG. 10 shows the exhaust vent cap assembly installed in a roof deck and connected to a duct, according to an exemplary embodiment of the present invention.

FIG. 10 shows the exhaust vent cap assembly installed on an underside of a roof deck 430 and secured to the duct 400 of the ventilation system. First, a hole can be made in the roof deck 430. The diameter of the hole in the roof deck can be the same as the external diameter of the mouth of the tubular body 410, such as the mouth can slide into the hole. The mouth is inserted into the hole while the flange 420 rests against the underneath of the roof deck 430. The flange 420 can then be secured to the roof deck using fasteners. The mouth of the tubular body can extend above the roof surface. Cap 450 can be secure to the mouth for preventing the ingress of water into the duct.

The duct 400 can be pushed onto the distal end of the tubular body and secured using fasteners 440 and/or a strap. A tubular body can have a protrusion 460 that further prevents slipping of the duct over the tubular body. An instruction label will be affixed or printed on the cap for a roofer to remove before they install the permanent roof cap 470.

Alternatively, this disclosed exhaust vent cap assembly can also be attached to one end of the exhaust duct in a factory for ease of installation in the field. All the installer has to do is to make a hole in the roof deck, as usual, insert the device through the hole and screw the flange with few fasteners underneath the roof deck and connect the other end to the exhaust fan. Roofers can remove the removable cap later without the chance of water entering the house or damaging the duct insulation.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method for installing an insulated duct of a ventilation system, the method comprising the steps of:

providing an exhaust vent cap assembly, the exhaust vent cap assembly comprising:

a tubular body, the tubular body comprising:

a hollow tube having a proximal end and a distal end, a flange extends around a periphery of the proximal end perpendicularly to the hollow tube, and a mouth upstanding from the proximal end of the hollow tube, a cap configured to sealably fasten to the mouth, the cap and the mouth having a fastening mechanism, wherein an outer diameter of the cap is substantially same as an outer diameter of the mouth;

making a hole in a roof deck, the diameter of the hole permits the mouth of the tubular body to slide into the hole;

inserting the mouth of the tubular body into the hole, wherein the flange rests against an underneath of the roof deck;

securing the flange to the roof deck using one or more screws;

upon securing the flange, securing the insulated duct to the tubular body; and later removing the cap from the mouth; and upon removing the cap, installing a permanent roof cap.

2. The method according to claim 1, wherein the mouth and the hollow tube are integral, and the flange is mechanically attached.

3. The method according to claim 1, wherein the flange and the hollow tube are integral, and the mouth is mechanically attached.

4. The method according to claim 1, wherein the flange and the mouth are integral and hollow tube is mechanically attached.

5. The method according to claim 1, wherein the hollow tube, the mouth, and the flange are integral.

6. The method according to claim 1, wherein the cap and the mouth are having threads for securing the cap to the mouth, the cap is having a handle for turning the cap.

7. The method according to claim 1, wherein the cap and the mouth are configured for snap-fitting the cap onto the mouth.

8. The method according to claim 7, wherein the cap is having a furrow as a handle for lifting the cap.

9. The method according to claim 1, wherein the cap and the mouth are configured for friction fit.

10. The method according to claim 1, wherein the exhaust vent cap assembly further comprises an O-ring between the cap and the mouth for water tightness.

11. The method according to claim 1, wherein the flange is planar.

* * * * *